US006836639B2

(12) United States Patent
Karakama et al.

(10) Patent No.: US 6,836,639 B2
(45) Date of Patent: Dec. 28, 2004

(54) CLEANING APPARATUS HAVING A CLEANING MEMBER, A CLEANING FRAME, AND A CONNECTING PORTION CONNECTING BOTH END SURFACES OF THE FRAME

(75) Inventors: Toshiyuki Karakama, Shizuoka (JP); Takeo Shoji, Shizuoka (JP); Ryuta Murakami, Shizuoka (JP); Tomonori Matsunaga, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,209

(22) Filed: Jul. 30, 2002

(65) Prior Publication Data

US 2003/0156869 A1 Aug. 21, 2003

(30) Foreign Application Priority Data

Feb. 20, 2002 (JP) ..... 2002/043125

(51) Int. Cl.[7] ..... G03G 21/00

(52) U.S. Cl. ..... 399/351; 399/123; 399/350

(58) Field of Search ..... 399/111, 123, 399/343, 350, 351

(56) References Cited

U.S. PATENT DOCUMENTS

| | | | | |
|---|---|---|---|---|
| 4,730,205 A | * | 3/1988 | Ogiri et al. | 399/350 X |
| 5,095,335 A | | 3/1992 | Watanabe et al. | 355/210 |
| 5,208,634 A | | 5/1993 | Ikemoto et al. | 355/215 |
| 5,294,960 A | | 3/1994 | Nomura et al. | 355/210 |
| 5,331,372 A | | 7/1994 | Tsuda et al. | 355/200 |
| 5,455,665 A | | 10/1995 | Baba et al. | 355/298 |
| 5,470,635 A | | 11/1995 | Shirai et al. | 428/131 |
| 5,500,714 A | | 3/1996 | Yashiro et al. | 355/200 |
| 5,543,898 A | | 8/1996 | Shishido et al. | 355/210 |
| 5,565,961 A | | 10/1996 | Shoji et al. | 355/200 |
| 5,585,895 A | | 12/1996 | Yashiro et al. | 355/215 |
| 5,608,509 A | | 3/1997 | Shirai et al. | 399/351 |
| 5,617,579 A | | 4/1997 | Yashiro et al. | 399/114 |
| 5,623,328 A | | 4/1997 | Tsuda et al. | 399/111 |
| 5,689,774 A | | 11/1997 | Shishido et al. | 399/111 |
| 5,749,027 A | | 5/1998 | Ikemoto et al. | 399/113 |
| 5,768,660 A | | 6/1998 | Kurihara et al. | 399/111 |
| 5,774,766 A | | 6/1998 | Karakama et al. | 399/111 |
| 5,794,101 A | | 8/1998 | Watanabe et al. | 399/103 |
| 5,812,909 A | | 9/1998 | Oguma et al. | 399/103 |
| 5,828,928 A | | 10/1998 | Sasago et al. | 399/111 |
| 5,835,818 A | | 11/1998 | Hoshika et al. | 399/26 |
| 5,878,310 A | | 3/1999 | Noda et al. | 399/117 |
| 5,884,124 A | | 3/1999 | Karakama et al. | 399/123 |
| 5,890,036 A | | 3/1999 | Karakama et al. | 399/119 |
| 5,899,602 A | | 5/1999 | Noda et al. | 399/111 |
| 5,920,752 A | | 7/1999 | Karakama et al. | 399/111 |
| 5,943,528 A | | 8/1999 | Akutsu et al. | 399/110 |
| 5,966,566 A | | 10/1999 | Odagawa et al. | 399/109 |
| 6,032,007 A | | 2/2000 | Yamaji et al. | 399/104 |
| 6,070,028 A | | 5/2000 | Odagawa et al. | 399/104 |
| 6,101,354 A | | 8/2000 | Nakagawa et al. | 399/225 |
| 6,160,976 A | | 12/2000 | Karakama et al. | 399/104 |
| 6,253,036 B1 | | 6/2001 | Karakama et al. | 399/27 |
| 6,253,044 B1 | | 6/2001 | Shoji et al. | 399/111 |

(List continued on next page.)

*Primary Examiner*—Fred Braun
(74) *Attorney, Agent, or Firm*—Fitzpatrick, Cella, Harper & Scinto

(57) ABSTRACT

A cleaning apparatus includes a cleaning member for cleaning off toner from an image bearing member, a support member for supporting the cleaning member, and a receiving portion for receiving the toner cleaned off by the cleaning member, the receiving portion having a cleaning frame, and a connecting portion for connecting both end surfaces of the cleaning frame in a longitudinal direction of the cleaning member, in which the support member is provided with a bent portion bent on a deeper side of the cleaning frame, and the connecting portion is below an upper portion of the receiving portion and above a lower surface of the bent portion.

8 Claims, 16 Drawing Sheets

U.S. PATENT DOCUMENTS 6,266,500 B1 7/2001 Numagami et al. ..... 399/104
6,266,502 B1 * 7/2001 Matsuzaki et al. ..... 399/123 X
6,330,402 B1 12/2001 Sakurai et al. ..... 399/12
6,397,017 B1 5/2002 Sakai et al. ..... 399/27
6,397,018 B1 5/2002 Matsumoto et al. ..... 399/27
6,408,143 B2 6/2002 Sakurai et al. ..... 399/27

* cited by examiner

CLEANING APPARATUS HAVING A CLEANING MEMBER, A CLEANING FRAME, AND A CONNECTING PORTION CONNECTING BOTH END SURFACES OF THE FRAME

BACKGROUND OF THE INVENTION

1. Field of the Invention

The present invention relates to a cleaning apparatus that may be used in an image forming apparatus such as a copying machine or a printer or in a process cartridge that is detachably mountable in the image forming apparatus, and to a cleaning apparatus for cleaning an image bearing member such as a photosensitive member and a dielectric.

In this case, the image forming apparatus is an apparatus for forming an image on a recording medium by using, for example, an electrophotographic image forming process and includes, for example, an electrophotographic copying machine, an electrophotographic printer (for example, a laser beam printer and an LED printer), a facsimile machine and a word-processor and the like.

Also, the process cartridge is made into a cartridge by integrating at least one of charging means, developing means, and cleaning means with an electrophotographic photosensitive member which is the image bearing member, and is detachably mountable in an image forming apparatus main body.

2. Description of Related Art

Conventionally, in the image forming apparatus using the electrophotographic image forming process, a process cartridge system has been adopted in which an electrophotographic photosensitive member and a processing means for acting on the photosensitive member are integrally made into a cartridge to be detachably mountable in an image forming apparatus main body. According to this process cartridge system, the user may perform the maintenance of the apparatus by himself or herself without depending on a service person so that the operability may be considerably enhanced. Accordingly, the process cartridge system has been used extensively in the electrophotographic image forming apparatus.

By the way, in recent years, there has been a strong demand for a longer service life of the process cartridge and the image forming apparatus main body in conformity with a change in commercial needs. Although it is necessary to increase an amount of toner contained in the cartridge, the size of a waste toner container must be also enlarged in proportion to the increase of the toner. For example, if the amount of toner is doubled, the size of the container must be doubled and the size of the waste toner container also must be doubled. Accordingly, the cleaning container has conventionally been formed by connecting two frames of a cleaning frame and a cleaning lid, thereby increasing the volume of the cleaning container.

FIG. 12 is a cross-sectional view of a conventional process cartridge and FIG. 13 is an exploded perspective view illustrating the process cartridge. In the process cartridge E shown in FIG. 12, a cleaning frame 113 of a cleaning means 110 supports a photosensitive drum 107 that is an electrophotographic photosensitive member and causes a cleaning blade 110*a* to abut against the photosensitive drum 107 to remove toner remaining on the photosensitive drum 107. A cleaning lid 114 that is a second cleaning frame is connected with a cleaning container 113*a* that is a first cleaning frame by ultrasonic welding or friction welding such as vibration welding to form the cleaning frame 113.

In the cleaning frame 113, a support member 110*c* supporting the cleaning blade 110*a* that is the cleaning member is fixed by screws to a mounting surface 113*b* provided on the cleaning container 113*a* to form a waste toner reservoir 110*b*. In the seal structure of the cleaning blade 110*a* and the cleaning container 113*a*, an elastic seal member 115 is arranged in a full length in the longitudinal direction on a seal seat surface 113*c* to which the mounting surface 113*b* arranged on both ends is connected in the longitudinal direction and the support member 110*c* is fixed thereon by screws to the mounting surface 113*b*, thereby eliminating the gap between the support member 110*c* and the cleaning container 113*a* to prevent the leakage of the toner from the waste toner reservoir 110*b*. At this time, the seal seat surface 113*c* is located lower than the mounting surface 13*b* by a thickness corresponding to the condition after the compression of the seal. Also, a welding portion 113*d* of the cleaning container 113*a* is connected with the seal seat surface 113*c*.

Also, FIG. 14 is a view of the cleaning frame 113*a* as viewed in a mounting direction of the cleaning lid 114. As shown in FIG. 14, an internal wall distance 113L2 of the waste toner reservoir 110*b* of the mounting surface 113*b* is longer than a distance 113L1 between the mounting surfaces 113*b* at both ends to thereby increase the volume of the waste toner reservoir 110*b*.

However, when the cleaning frame is constituted by friction-welding the cleaning container and the cleaning lid, the deformation of each member is generated upon welding. This is due to the rigidity of the container, the flatness of the welding surface, the welding condition of the welder (welding strength, welding time) or the like. It is impossible to completely suppress the deformation in view of discrepancies in two-piece resin products.

Then, in the above-described structure, there is much deformation also in the cleaning frame and the cleaning lid upon welding. According to this deformation, the positional relationship of the photosensitive drum mounting portion with the cleaning blade positioning portion is changed.

For this reason, after attaching the cleaning blade to the cleaning container, the positional measurement of the cleaning blade is performed in every step. Also, for the one displaced considerably from a regular position, the reattachment of the cleaning blade is performed.

SUMMARY OF THE INVENTION

An object of the present invention is to provide a cleaning apparatus for preventing the deformation of a cleaning frame.

Another object of the present invention is to provide a cleaning apparatus for enhancing the mechanical strength of the cleaning frame.

Still another object of the present invention is to provide a cleaning apparatus for enhancing the positional precision of the cleaning member.

Still another object of the present invention is to provide a cleaning apparatus for reducing the number of assembling steps for the cleaning apparatus.

Still another object of the present invention is to provide a cleaning apparatus for enhancing the toner containing amount of the cleaning apparatus.

Still other objects and features of the present invention will become apparent by reading the following detailed description with reference to the accompanying drawings.

DESCRIPTION OF THE PREFERRED EMBODIMENTS

First Embodiment

Figure 1:
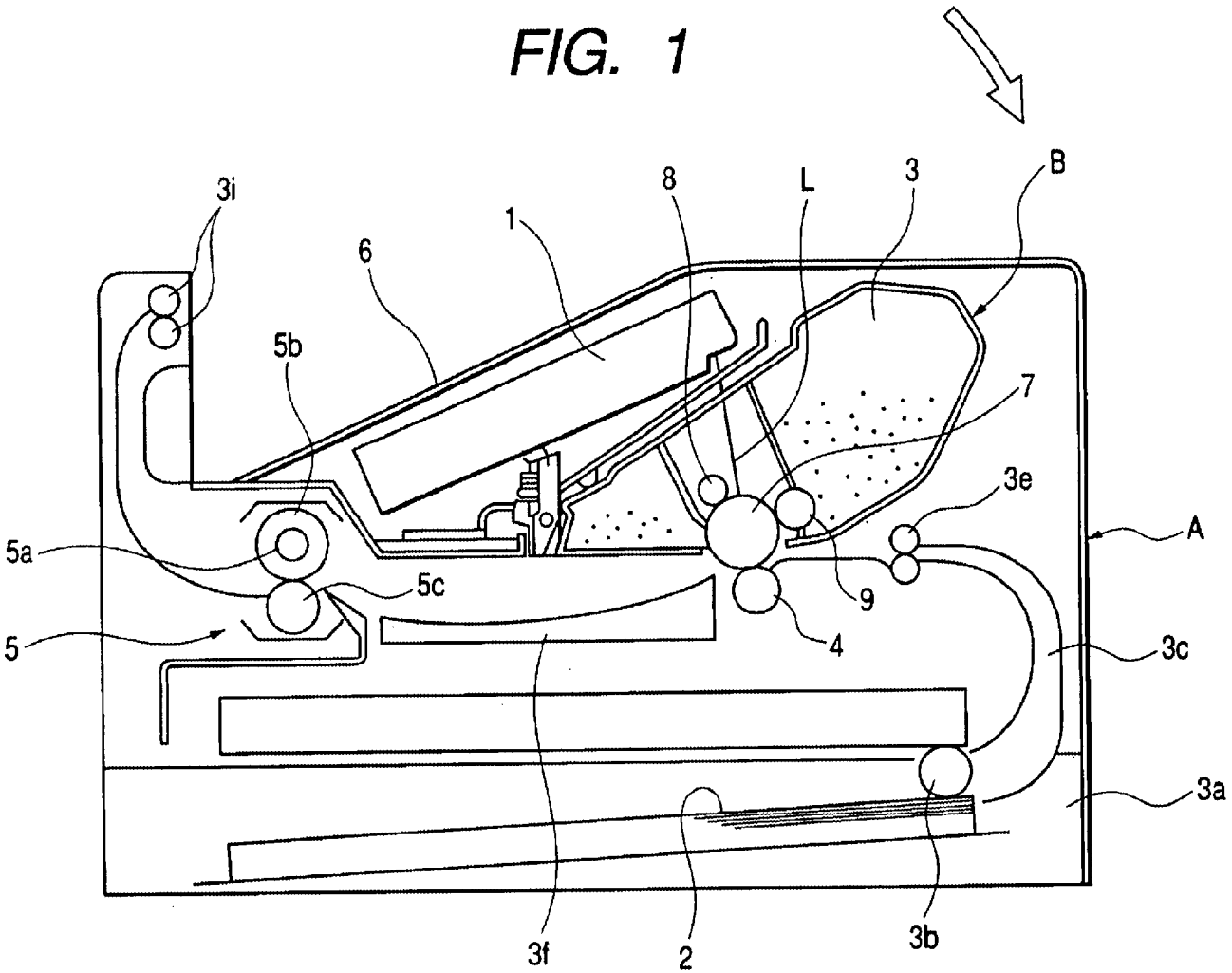
FIG. 1 is an overview of a structure of an image forming apparatus according to an embodiment of the present invention.
Figure 2:
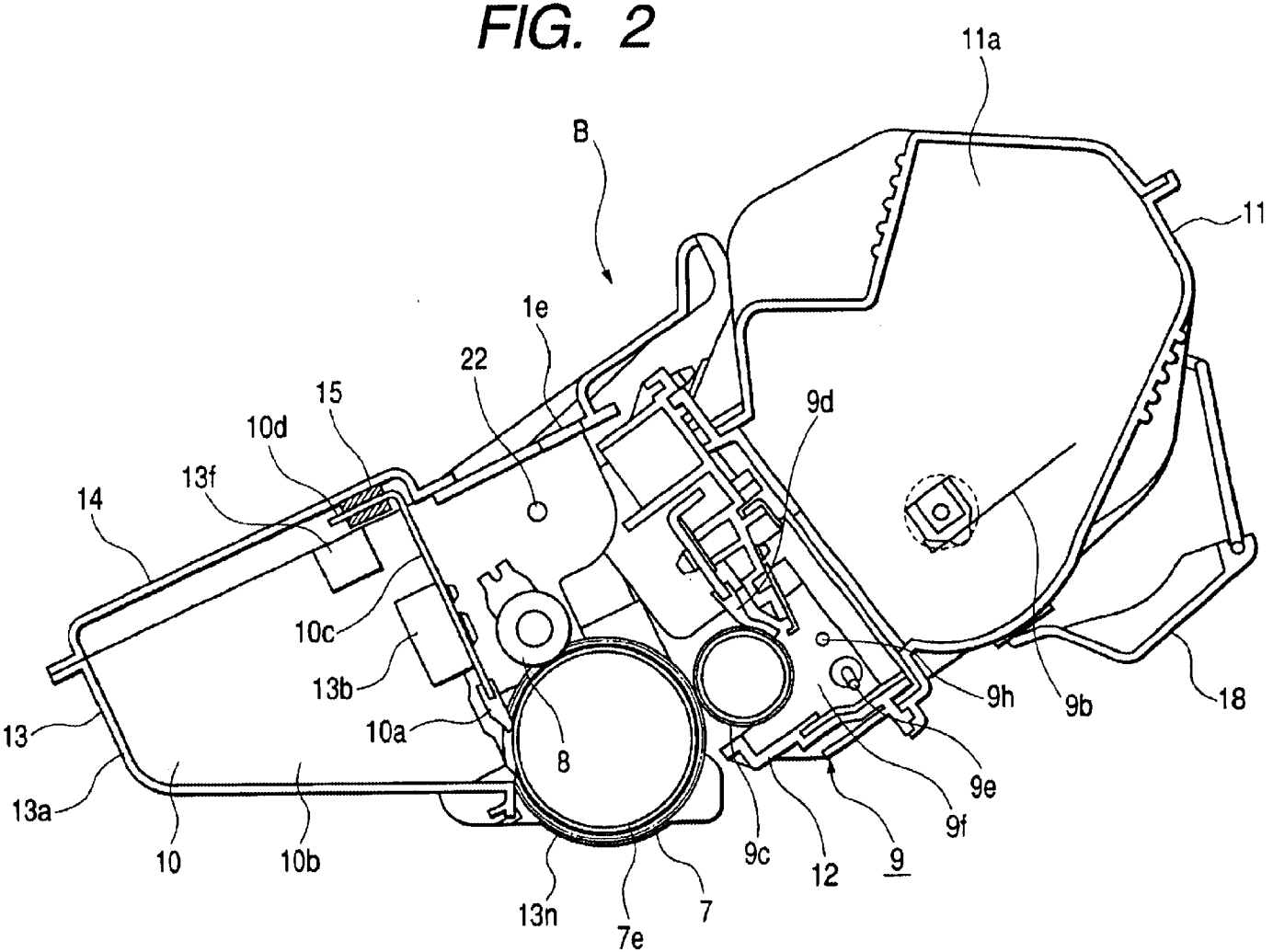
FIG. 2 is a cross-sectional view illustrating a structure of a process cartridge.
Figure 3:
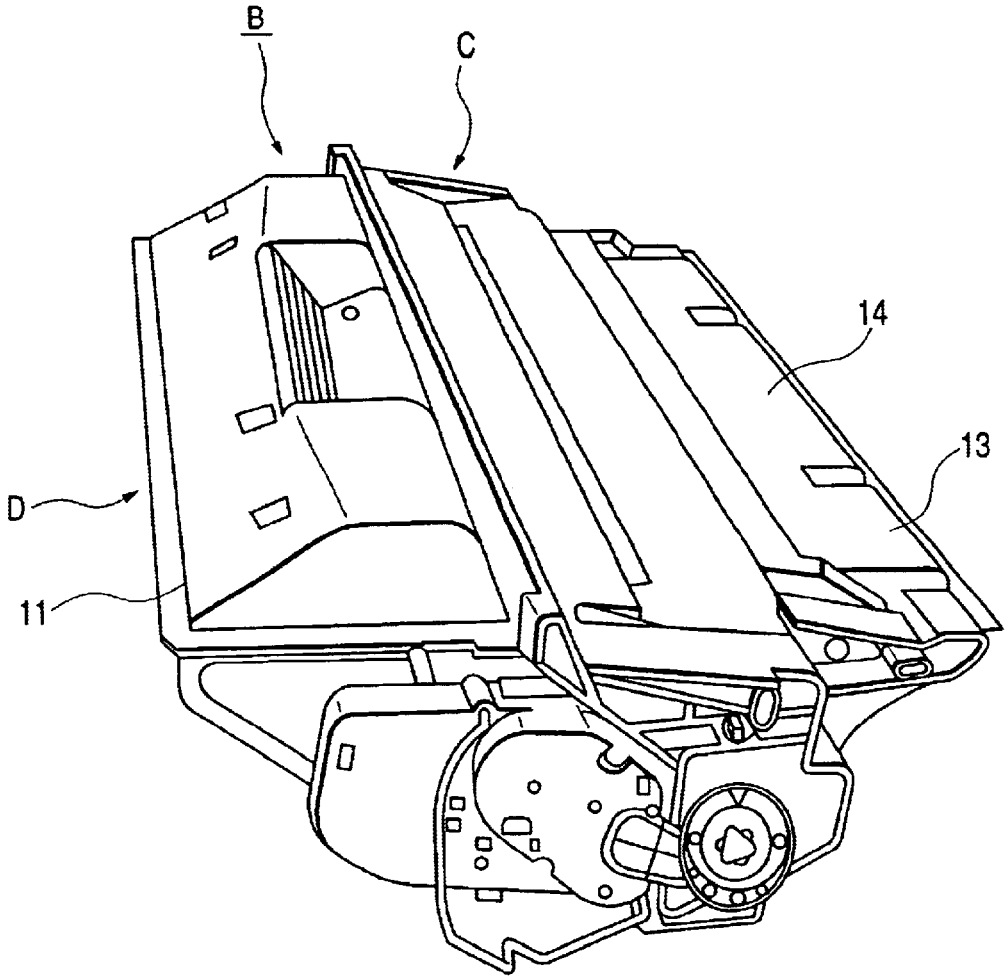
FIG. 3 is a perspective view of the process cartridge.
Figure 4:
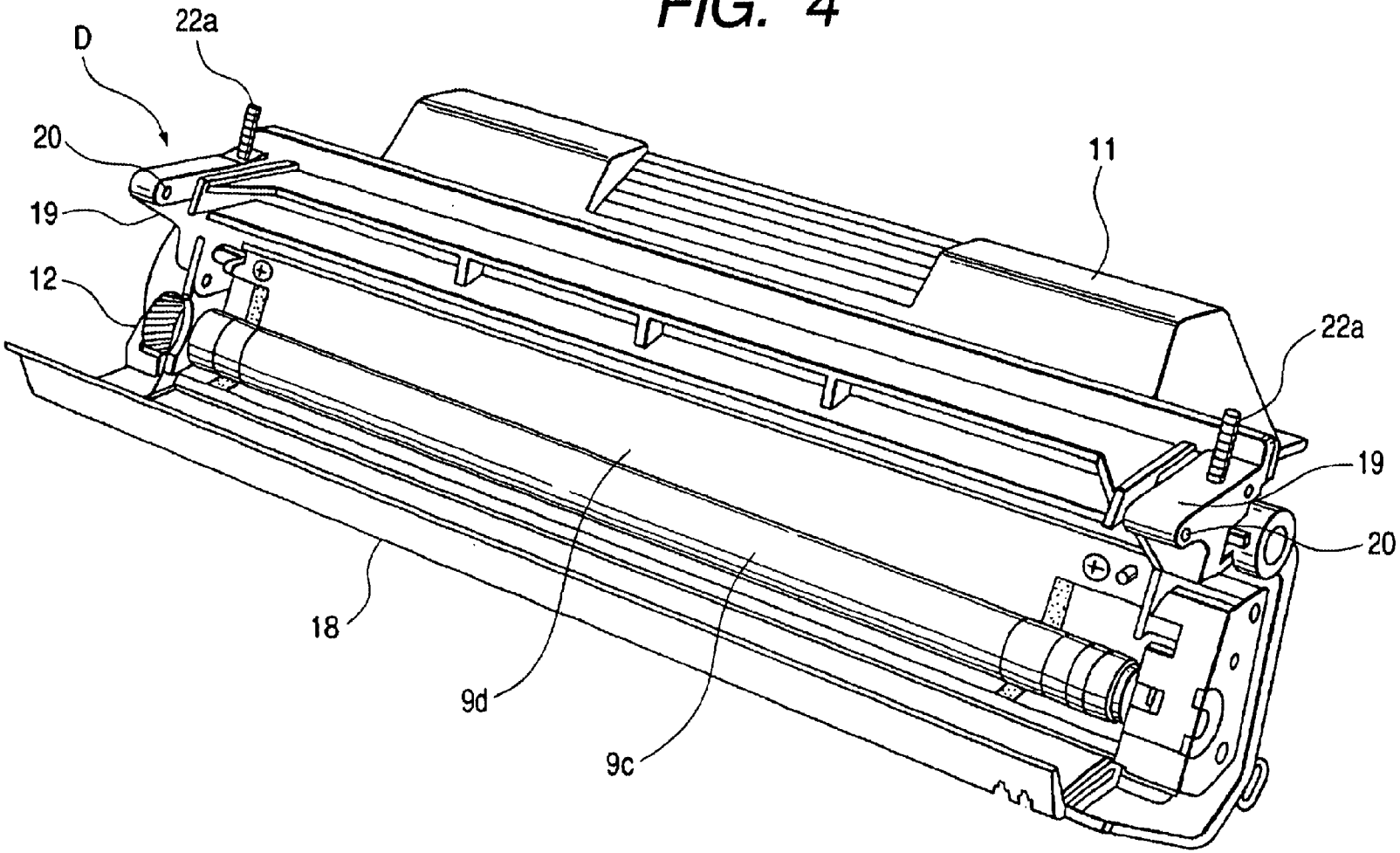
FIG. 4 is a perspective view illustrating a second cleaning frame.
Figure 5:
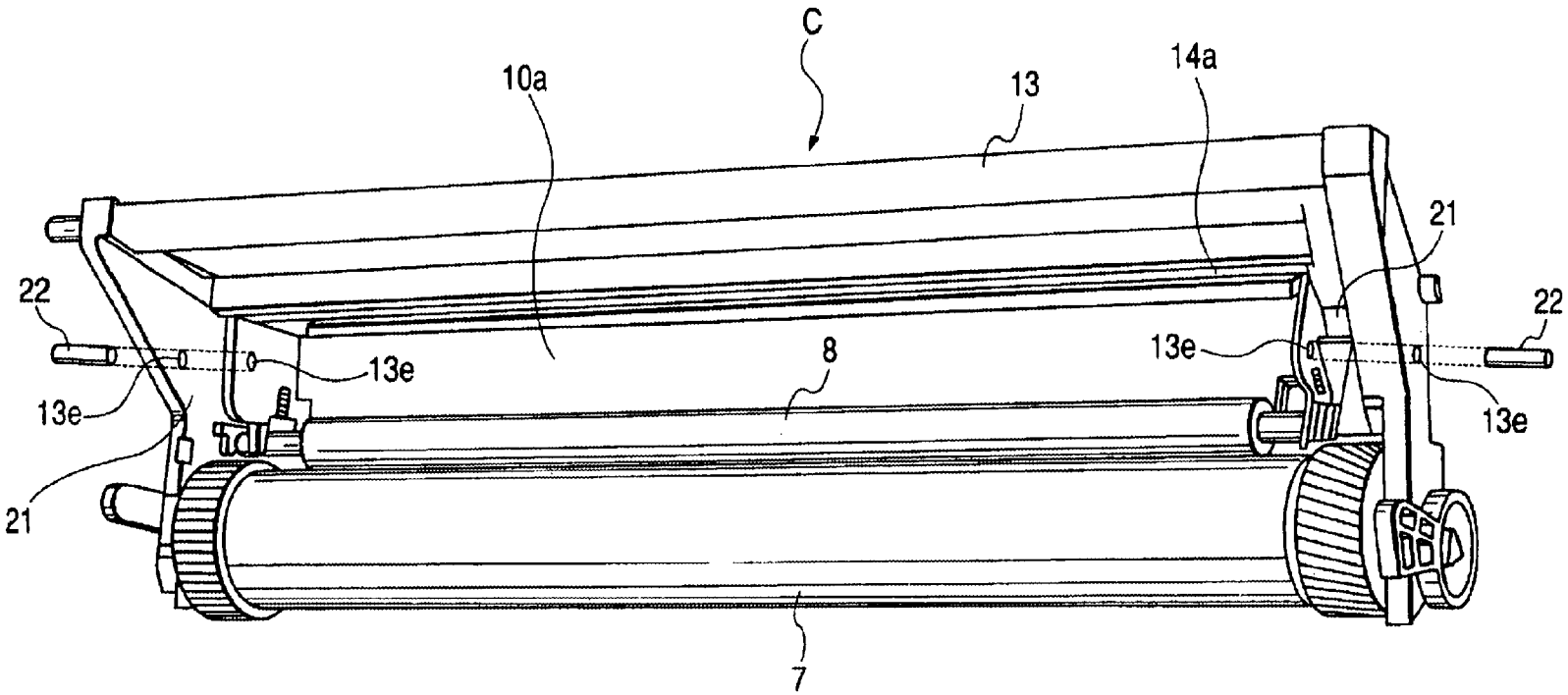
FIG. 5 is a perspective view illustrating a first cleaning frame.
Figure 6:
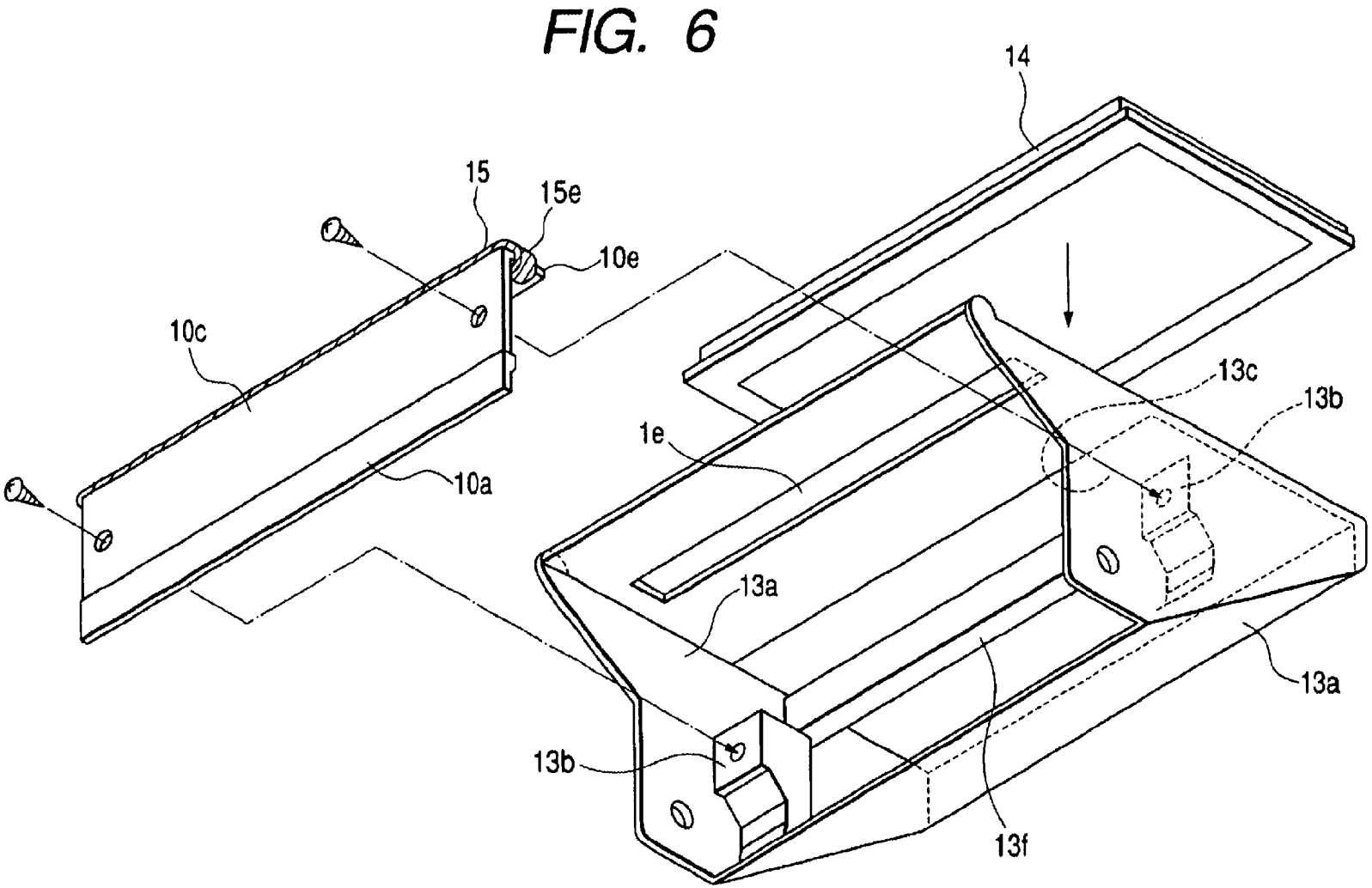
FIG. 6 is an exploded perspective view showing the structure of the cleaning frame.

A process cartridge and an image forming apparatus according to a first embodiment to which a cleaning apparatus according to the present invention may be applied will now be described with reference to the accompanying drawings. FIG. 1 is an overall structural view of an image forming apparatus according to the embodiment, FIG. 2 is a cross-sectional view illustrating a structure of the process cartridge, FIG. 3 is a perspective view of the process cartridge, FIG. 4 is a perspective view illustrating a second cleaning frame, FIG. 5 is a perspective view illustrating a first frame and FIG. 6 is an exploded perspective view illustrating a structure of a cleaning frame.

In this embodiment, the image forming apparatus and the process cartridge B will now be described. The process cartridge B is used in the image forming apparatus. Incidentally, the lateral direction of the process cartridge B in the following description is a direction in which the process cartridge B is mounted to or detached from the image forming apparatus main body (hereinafter referred to as an "apparatus main body A") and corresponds to the transport direction of the recording medium. Also, the longitudinal direction of the process cartridge B is a direction that crosses (substantially perpendicular to) a direction in which the process cartridge B is mounted to or detached from the apparatus main body A, and the longitudinal direction is parallel to the surface of the recording medium and crosses (substantially perpendicular to) the transport direction of the recording medium. Also, the right and left directions relating to the process cartridge B mean the right and left directions of the recording medium as viewed from above in the transport direction of the recording medium. Also, the upper surface of the process cartridge B in the following description is a surface located upwardly under the condition that the process cartridge B is mounted in the apparatus main body A and the lower surface is a surface located downwardly in the same condition.

Image Forming Structure and Operation of Image Forming Apparatus and Process Cartridge A laser beam printer will be first exemplified and explained as an electrophotographic image forming apparatus according to the embodiment with reference to FIG. 1. In the apparatus main body A of the laser beam printer, an image is formed on a recording medium 2 (for example, recording paper, OHP sheet, cloth or the like) by an electrophotographic image forming process. A toner image is then formed on a drum-shaped electrophotographic photosensitive member (hereinafter referred to as a photosensitive drum 7) as an image bearing member. More specifically, the photosensitive drum 7 is charged by a charging roller 8, and subsequently, a laser beam L is projected in response to image information from optical means 1 to the photosensitive drum 7 to form thereon a latent image in conformity with the image information. Then, the latent image is developed by developing means 9 to form a toner image.

On the other hand, in synchronism with the formation of the toner image, the recording medium 2 set in a feed cassette 3*a* is inverted and transported by a pickup roller 3*b*, a transport guide 3*c* and a pair of registration rollers 3*e*. Subsequently, the toner image formed on the photosensitive drum 7 of the process cartridge B is transferred to the recording medium 2 by applying a voltage to the transfer roller 4 used as transfer means.

Thereafter, the recording medium 2 that is subjected to the transfer of the toner image is transported to fixing means 5 by a transport guide 3*f*. The fixing means 5 has a drive roller 5*c* and a fixing roller 5*b* incorporating a heater 5*a*. The toner image is transferred by the application of heat and pressure to the passing recording medium 2. Then, the recording medium 2 is transported by a pair of delivery rollers 3*i* to be delivered to a delivery tray 6.

The process cartridge B will now be described with reference to FIG. 2.

In the process cartridge B, the photosensitive drum 7 having a photoconductive layer 7*e* is rotated so that the surface of the photosensitive drum 7 is uniformly charged by the voltage application to the charging roller 8 that is the charging means. Subsequently, the laser beam, in response to the image information from the optical means 1, irradiates the photosensitive drum 7 through an exposure opening portion 1*e* to form the latent image. Then, the latent image is developed by the developing means 9 by using the toner. More specifically, the charging roller 8 is provided in contact with the photosensitive drum 7 to thereby charge the photosensitive drum 7. Incidentally, the charging drum 8 is driven and rotated by the photosensitive drum 7. Also, the developing means 9 feeds the toner to the developing region of the photosensitive drum 7 and develops the latent image formed on the photosensitive drum 7.

The developing means 9 feeds the toner within a toner container 11*a* to the developing roller 9*c* by the rotation of a toner feed member 9*b*. Then, the developing roller 9*c* incorporating a stationary magnet is rotated, and at the same time a toner layer provided with a frictional electric charge is formed on a surface of the developing roller 9*c* by the developing blade 9*d*. The toner is fed to the developing region of the photosensitive drum 7. Then, the toner is moved to the photosensitive drum 7 in response to the latent image to thereby form the toner image to be visible.

The developing blade 9*d* is used to regulate the amount of toner on the circumferential surface of the developing roller 9*c* and to give a frictional electric charge to the toner. Also, a toner agitating member 9*e* for circulating the toner within a developing chamber 9*f* is rotatably mounted in the vicinity of the developing roller 9*c*.

Subsequently, a voltage having an opposite polarity to that of the toner image is applied to the transfer roller 4, and the toner image formed on the photosensitive drum 7 is transferred to the recording medium 2. Thereafter, the residual toner on the photosensitive drum 7 is removed by cleaning means 10. The cleaning means 10 scrapes off the toner remaining on the photosensitive drum 7 by an elastic cleaning blade that is a cleaning member provided in contact with the photosensitive drum 7 and to collect the toner in a waste toner reservoir 10*b* that is a waste toner collection portion.

Housing Structure of Process Cartridge

A housing structure of the process cartridge B in accordance with the embodiment will now be described. The process cartridge B has a housing formed by combining a toner frame 11 having a toner container 11*a* for containing the toner (toner containing portion) and a developing frame 12 for holding the developing means 9 such as the developing roller 9*c*, and further combining therewith a cleaning frame 13, to which the photosensitive drum 7, the cleaning means 10 such as a cleaning blade 10*a* and the charging roller 8 are attached, with the cleaning frame 13 being rotatable with respect to the combination of the toner frame 11 and the developing frame 12. Incidentally, the detail of the structure of the cleaning frame 13 will be described later. Then, the process cartridge B is mounted detachably to the cartridge mounting means provided in the apparatus main body A.

The exposure opening portion 1*e* for allowing the laser beam to irradiate the photosensitive drum 7 in response to the image information and a transfer opening portion 13*n* for causing the photosensitive drum 7 to be opposed to the recording medium 2 are provided in the process cartridge B. More specifically, the exposure opening portion 1*e* is provided on the cleaning frame 13 and the transfer opening portion 13*n* is defined between the developing frame 12 and the cleaning frame 13.

As shown in FIG. 2, the toner feed member 9*b* is rotatably attached to the toner frame 11. Also, the developing roller 9*c* and the developing blade 9*d* are attached to the developing frame 12 and furthermore an agitating member 9*e* is attached to the developing frame 12 to rotate in the vicinity of the developing roller 9*c* for circulating the toner within the developing chamber 9*f*. Also, an antenna rod 9*h* for detecting the amount of the toner is attached to the developing frame 12 opposite to the developing roller 9*c* and substantially in parallel with the developing roller 9*c* in the longitudinal direction. Then, the toner frame 11 and the developing frame 12 are welded (by ultrasonic welding in this embodiment) to form an integral developing unit D (see FIGS. 3 and 4).

Incidentally, a drum shutter member 18 for covering the photosensitive member 7 when the process cartridge B is removed away from the image forming apparatus main body A and for avoiding the exposure to the light for a long period of time and contact with foreign matter is attached to the developing unit D. Also, a cleaning unit C (see FIGS. 3 and 5) as a first cleaning frame is constituted by attaching the photosensitive drum 7, the charging roller 8 and the cleaning means 10, respectively to the cleaning frame 13.

Then, the process cartridge B is constituted by connecting the developing unit D and the cleaning unit C by connecting members 22 that are round pins so that the developing unit D and the cleaning unit C are rotatable with respect to one another. Namely, as shown in FIG. 4, round pivot holes 20 in parallel with the developing roller 9*c* are provided in the distal ends of the arm portions 19 formed on both sides in the longitudinal direction (in the axial direction of the developing roller 9*c*) of the developing frame 12. On the other hand, as shown in FIG. 5, recess portions 21 are provided for introducing the arm portions 19 at two positions at both sides in the longitudinal direction of the cleaning frame 13. The arm portions 19 are inserted into the recess portions 21, the connecting members 22 are press-fitted into attaching holes 13*e* of the cleaning frame 13 and the connecting members 22 are fitted into the pivot holes 20 at the ends of the arm portions 19 to be press-fitted into the holes 13*e* further on the inside so that the developing unit D and the cleaning unit C may be connected to be rotatable about the connecting members 22. At this time, compression coil springs 22*a* mounted and inserted into dowels (not shown) implanted in the proximal ends of the arm portions 19 are brought into contact with the upper surfaces of the recess portions 21 of the cleaning frame 13 and the developing frame 12 is biased downwardly by the compression coil springs 22*a* to thereby depress the developing roller 9*c* to the photosensitive drum 7 surely.

The first embodiment of a process cartridge and an image forming apparatus will next be described. FIG. 2 is a cross-sectional view of the process cartridge in accordance with the embodiment. FIG. 6 is exploded perspective view illustrating the structure of the cleaning frame.

In the cleaning frame 13 of this embodiment, after the support member 10*c* for supporting the cleaning blade 10*a* that is the cleaning member is fixed by screws to the attaching portion 13*b*, the two frames of the cleaning container (first cleaning frame) 13*a* and the cleaning lid (second cleaning member) 14 are connected together by vibration welding to be made into a single frame and the waste toner reservoir 10*b* that is the toner receiving portion is formed. At this time, an elastic seal member 15 is provided between the cleaning lid 14 and the support member 10*c*. When the cleaning container 13*a* and the cleaning lid 14 are connected together, the elastic seal member 15 is compressed between the upper surface 10*d* of the support member and the cleaning lid 14. The container 13*a* is provided with a first opening portion opposed to the photosensitive member 7 and a second opening portion on the top side of the container 13*a*. The cleaning blade 10*a* covers a part of the first opening portion and the lid member 14 covers the second opening portion.

Also, the elastic seal member 15 attached to the support member 10*c* is arranged at both end portions in the longitudinal direction, i.e., so as to enter onto surfaces different from the surface opposed to the cleaning lid 14 and covers a support member side surface 10*e*. Then, at each position 15*e* for covering the support member side surface 10*e*, the elastic seal member 15 is compressed with an inner wall 13*c* of the cleaning container 13*a* to thereby prevent the toner from leaking out of the waste toner reservoir 10*b*.

At this time, the elastic seal member 15 made of sponge material is attached to the support member 10*c* by an adhesive double-coated tape. However, it is possible to inject foamed elastomer, rubber or the like into the position of the elastic seal member 15.

Also, a beam 13*f* is provided as a connecting member for connecting both side surfaces in the longitudinal direction of the cleaning container 13*a* on the side (deep side) of the waste toner reservoir 10*b* of the cleaning blade 10*a* of the cleaning container 13*a* and in the vicinity of the welded portion of the cleaning lid 14. The beam 13*f* is provided in the lower portion below the uppermost portion of the waste toner reservoir 10*b* as the toner receiving portion, i.e., below the upper surface portion of the lid member 14 in the posture that the cleaning apparatus performs cleaning of the toner by the cleaning blade 10*a*. Thus, the beam 13*f* is provided whereby the rigidity of the peripheral portion of the welding portion with the cleaning lid 14 of the cleaning container 13*a* is enhanced. As a result, when the cleaning container 13*a* and the cleaning lid 14 are welded and connected, the cleaning lid 14 follows the shape of the cleaning container 13*a* that has high rigidity. Accordingly, the deformation upon the welding of the cleaning container 13*a* may be suppressed as much as possible. Accordingly, since the deformation due to the welding of the cleaning blade attaching portion 13*b* is also suppressed, it is possible to maintain the positional relationship between the cleaning blade 10*a* and the photosensitive drum 7 with high accuracy.

Then, as described above, in the structure, the support member 10*c* of the cleaning blade 10*a* is fixed by screws to the mounting portion 13*b* in the cleaning container 13*a* prior to welding and connecting the cleaning container 13*a* and the cleaning lid 14. For this reason, the rigidity of the cleaning container 13*a* is further enhanced and it is possible to maintain the positional relationship between the cleaning blade 10*a* and the photosensitive drum 7 with high accuracy.

Thus, in the process cartridge B with the structure according to the embodiment, since the positional relationship between the cleaning blade 10*a* and the photosensitive drum 7 may be kept with high accuracy, the step for measuring and confirming the positional relationship between the cleaning blade 10*a* and the photosensitive drum 7 may be dispensed with or may be performed by sampling (not all cartridges require inspection) to reduce the number of the manufacturing steps. Also, since, of course, there is no remarkable positional displacement in the positional relationship between the cleaning blade 10*a* and the photosensitive drum 7, the correction work therefor is not necessary.

Second Embodiment

Figure 7:
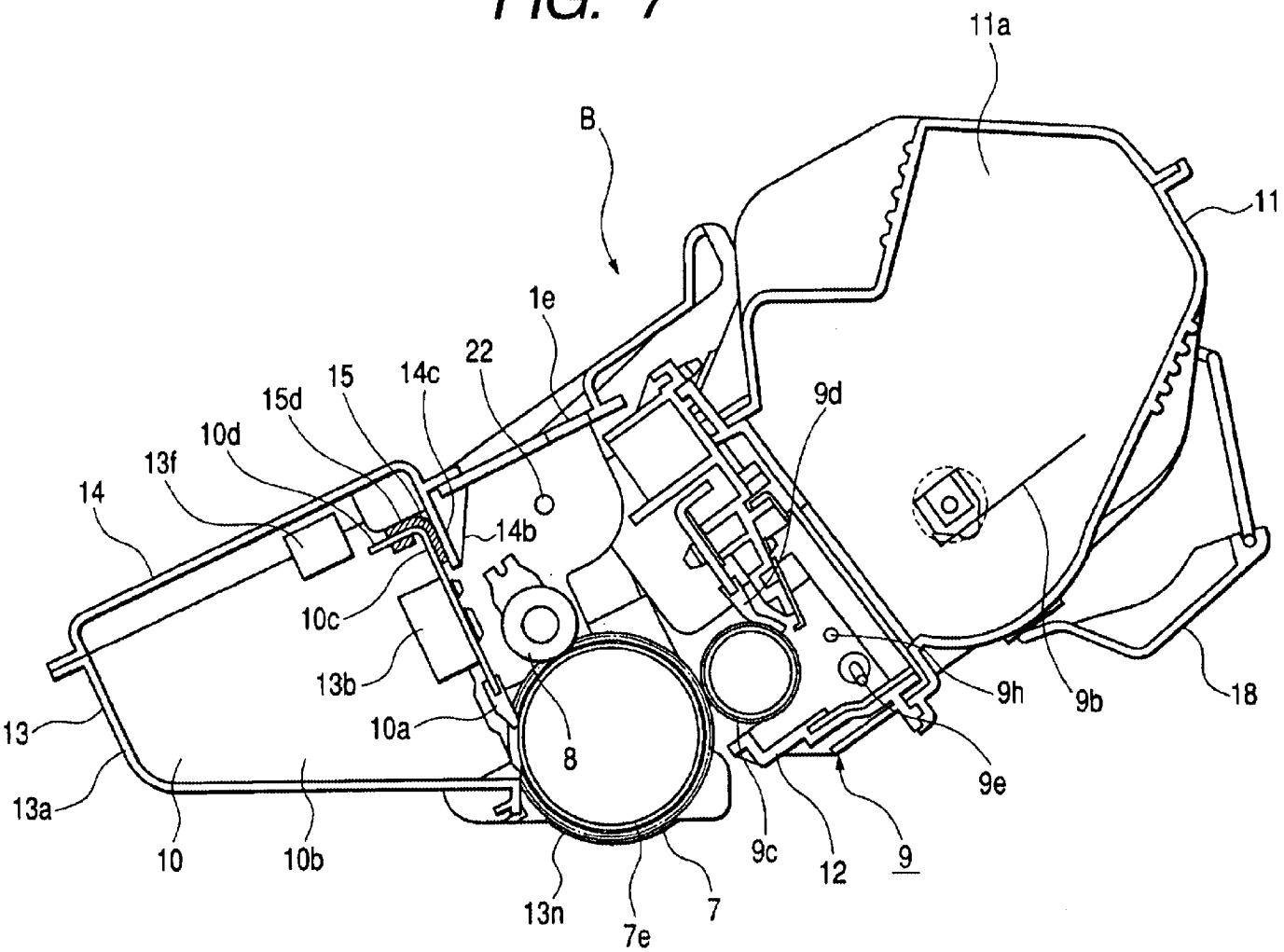
FIG. 7 is a view illustrating a structure of a process cartridge according to a second embodiment.
Figure 8:
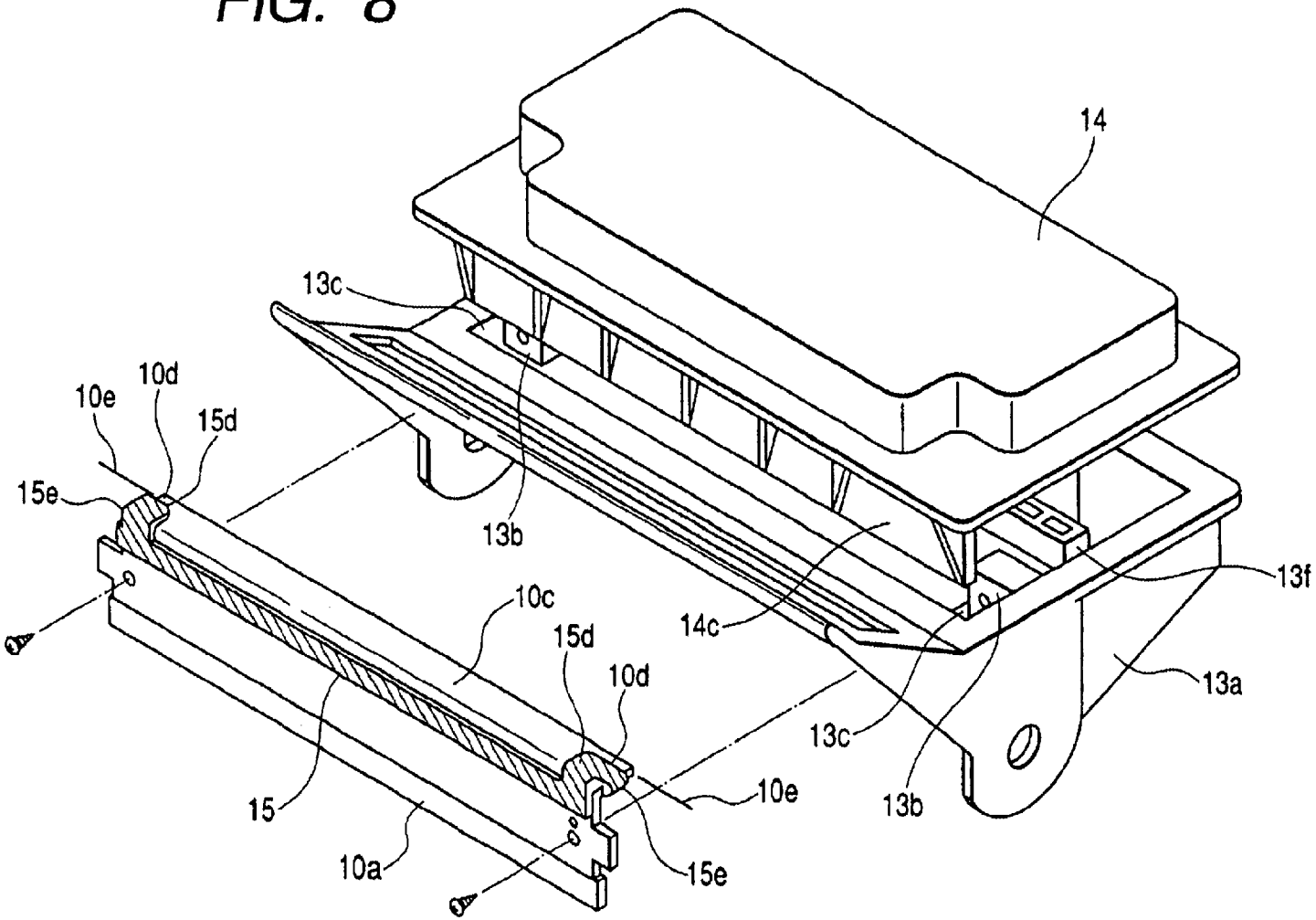
FIG. 8 is an exploded perspective view illustrating a structure of a cleaning frame according to the second embodiment.
Figure 9:
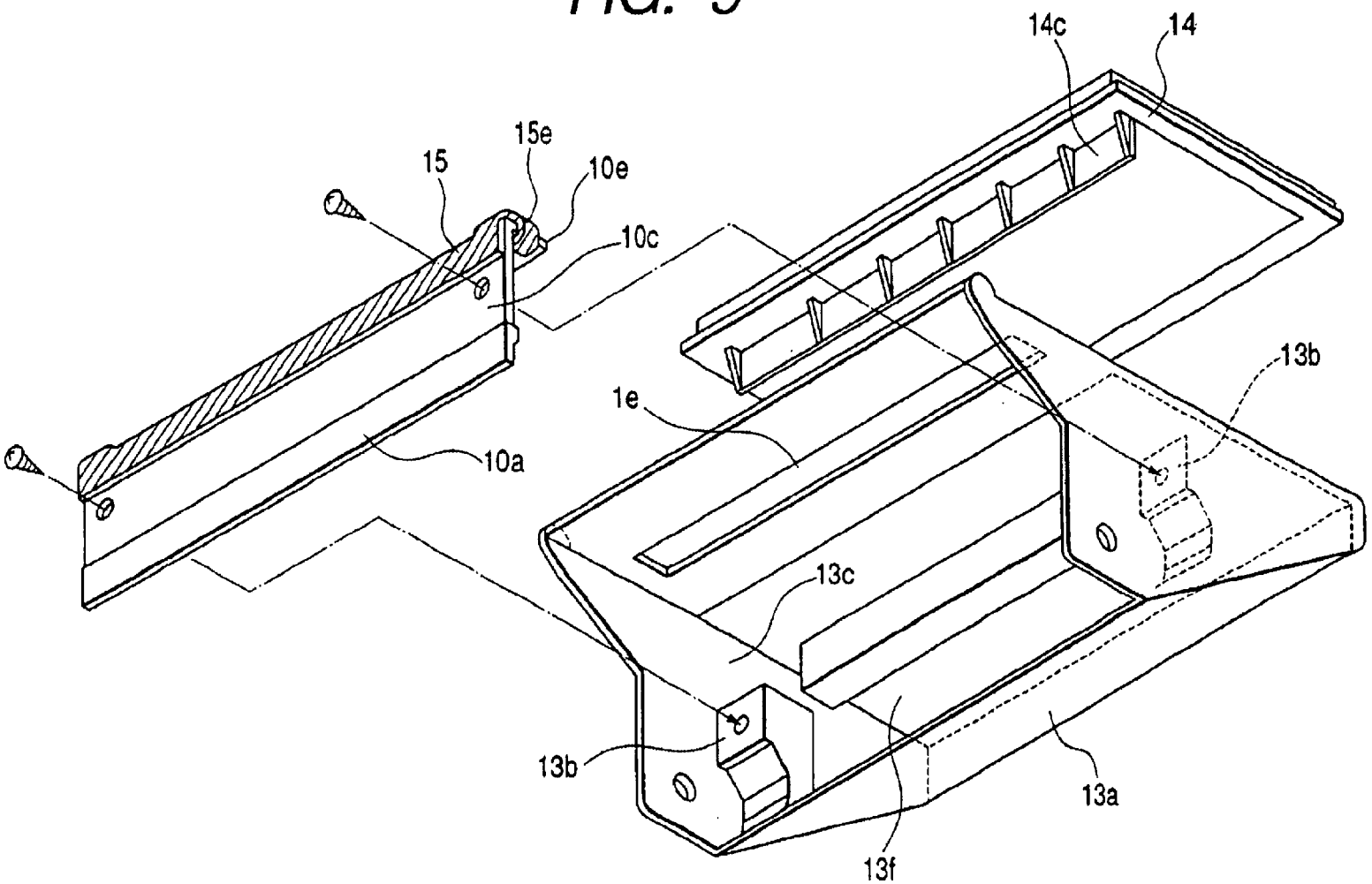
FIG. 9 is a view illustrating a structure of the process cartridge according to the second embodiment.

A second embodiment of a process cartridge and an image forming apparatus to which the cleaning apparatus according to the present invention may be applied will now be described. FIG. 7 is a cross-sectional view of a structure of the process cartridge in accordance with the embodiment. FIGS. 8 and 9 are exploded perspective views illustrating a structure of the cleaning frame. The same reference numerals are used to indicate the same components as the parts and members of the first embodiment and an explanation therefor that duplicates the explanation of the first embodiment will be omitted.

In the cleaning frame 13 in accordance with this embodiment, after the support member 10*c* of the cleaning blade 10*a* is fixed by screws to the attaching portion 13*b*, the two frames of the cleaning container 13*a* and the cleaning lid 14 are connected into one frame to form the waste toner reservoir 10*b*. In this case, a rib 14*c* opposed to the supporting member 10*c* is provided closer to the photosensitive drum 7 than the support member 10*c*. When the cleaning container 13*a* and the cleaning lid 14 are connected together, the elastic seal member 15 is compressed by the support member 10*c* and the rib 14*c*.

Also, the elastic seal member 15 attached to the support member 10*c* is arranged at both end portions in the longitudinal direction, i.e., so as to enter onto surfaces different from the surface opposed to the rib 14*c* and covers the support member side surface 10*e* and the support member upper surface 10*d*. Then, the elastic seal member 15 is compressed in the positions 15*e* covering the side surfaces 10*e* of the support member 10*c* by the inner wall 13*c* of the cleaning container 13*a* and in a position 15*d* covering the upper surface 10*d* of the support member 10*c* by the cleaning lid 14 to thereby prevent the toner from leaking out of the waste toner reservoir 10*b*.

At this time, the elastic seal member 15 made of sponge material is attached to the support member 10*c* by the adhesive double-coated tape. However, it is possible to inject foamed elastomer, rubber or the like into the position of the elastic seal member 15.

Also, the beam 13*f* is provided as the connecting member for connecting both side surfaces in the longitudinal direction of the cleaning container 13*a* on the side (deep side) of the waste toner reservoir 10*b* of the cleaning blade 10*a* of the cleaning container 13*a* and in the vicinity of the welded portion of the cleaning lid 14.

Figure 10:
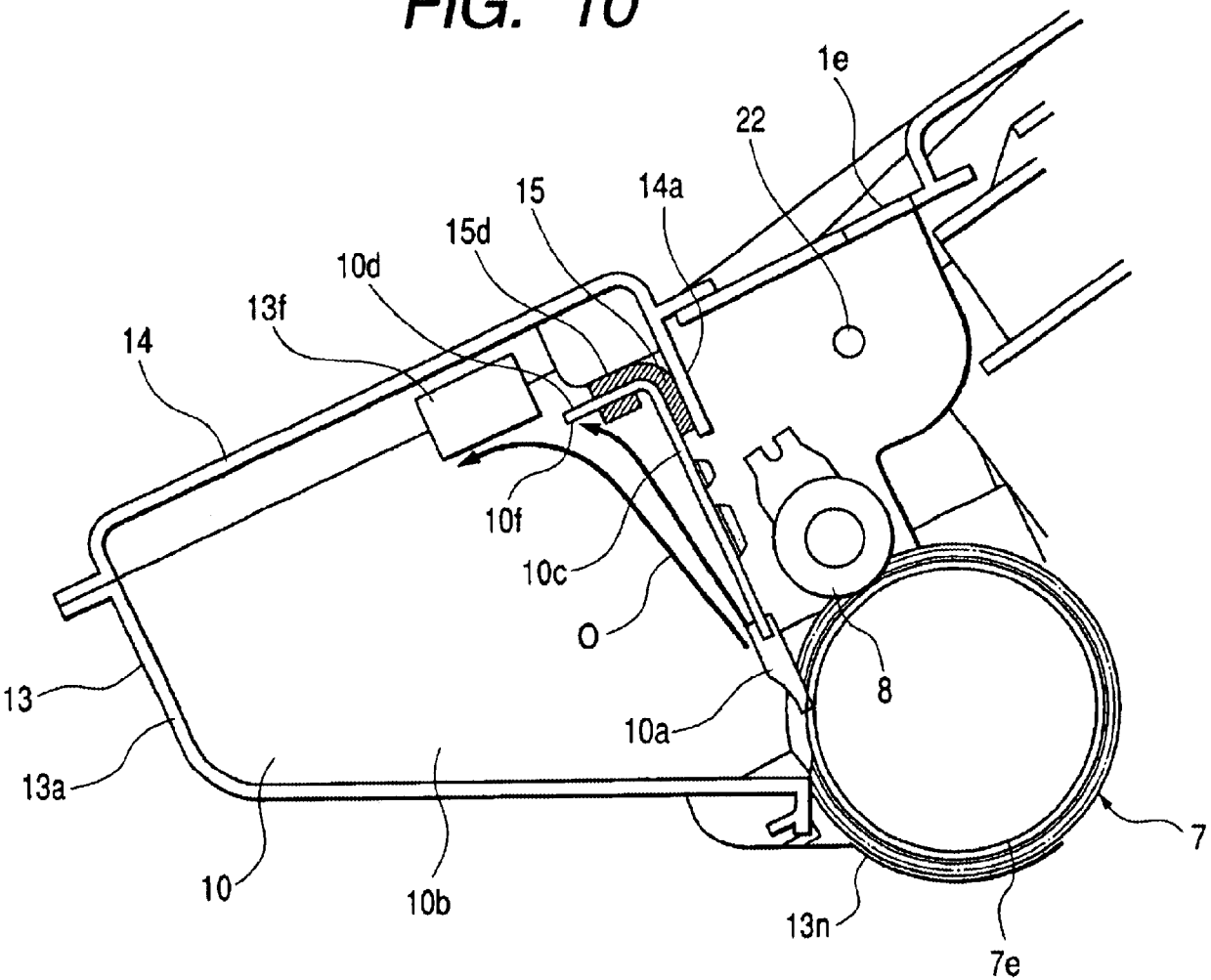
FIG. 10 is a cross-sectional view illustrating of how toner enters a cleaning container.

In this case, as shown in FIG. 10, the beam 13*f* is located above the extension plane of the support member lower surface 10*f* of the cleaning blade 10*a* in a posture that the cleaning apparatus cleans off the toner by the cleaning blade 10*a*. Also, the beam 13*f* is provided below the uppermost surface of the waste toner reservoir 10*b* that is the toner receiving portion, i.e., below the upper surface portion of the lid member 14 in the posture that the cleaning apparatus cleans off the toner by the cleaning blade 10*a*. Incidentally, the support member upper surface 10*d* is an upper surface of a bent portion where the support member 10*c* is bent on the deeper side of the container 13*a* and the support member lower surface 10*f* is a lower surface of the bent portion where the support member 10*c* is bent on the deeper side of the container 13*a*.

As a result, as described in conjunction with the above-described first embodiment, when the cleaning container 13*a* and the cleaning lid 14 are welded and connected, the cleaning lid 14 follows the shape of the cleaning container 13*a* that has high rigidity. Accordingly, the deformation upon the welding of the cleaning container 13*a* may be suppressed as much as possible. Accordingly, since the deformation due to the welding of the cleaning blade attaching portion 13*b* is also suppressed, it is possible to maintain the positional relationship between the cleaning blade 10*a* and the photosensitive drum 7 with high accuracy.

Figure 11:
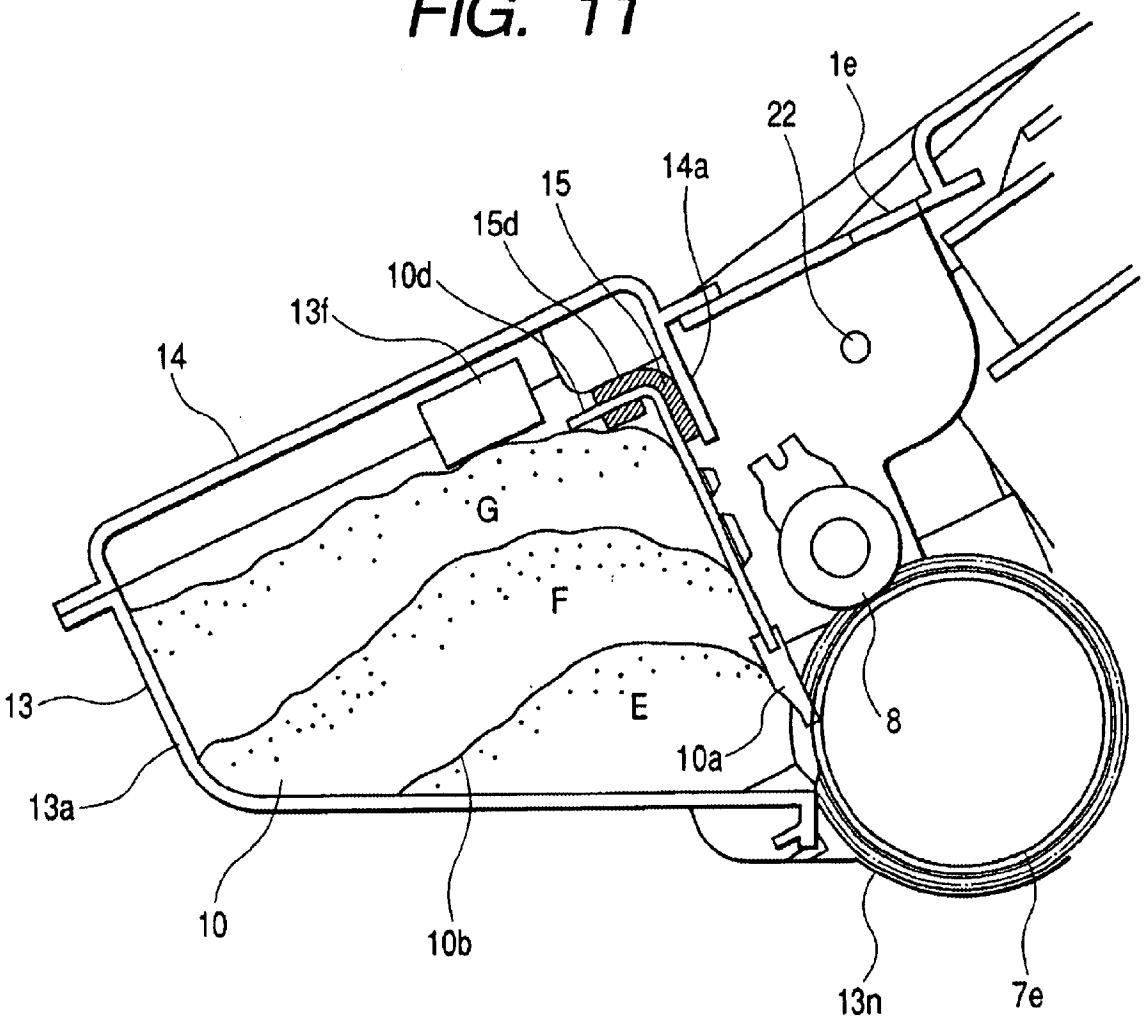
FIG. 11 is a cross-sectional view illustrating how the toner accumulates in the cleaning container.
Figure 12:
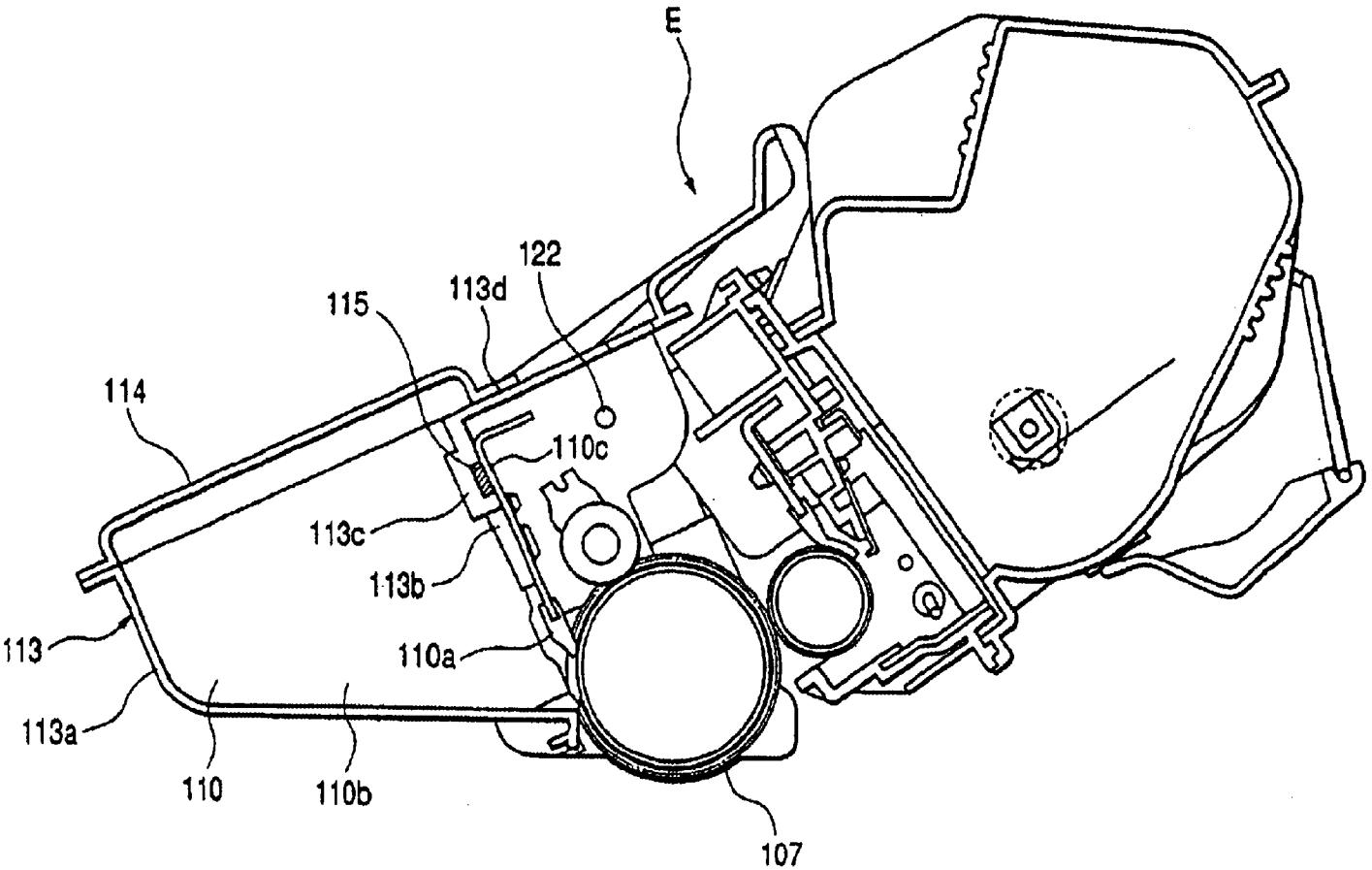
FIG. 12 RELATED ART
FIG. 12 is a cross-sectional view of a process cartridge according to a conventional example.
Figure 13:
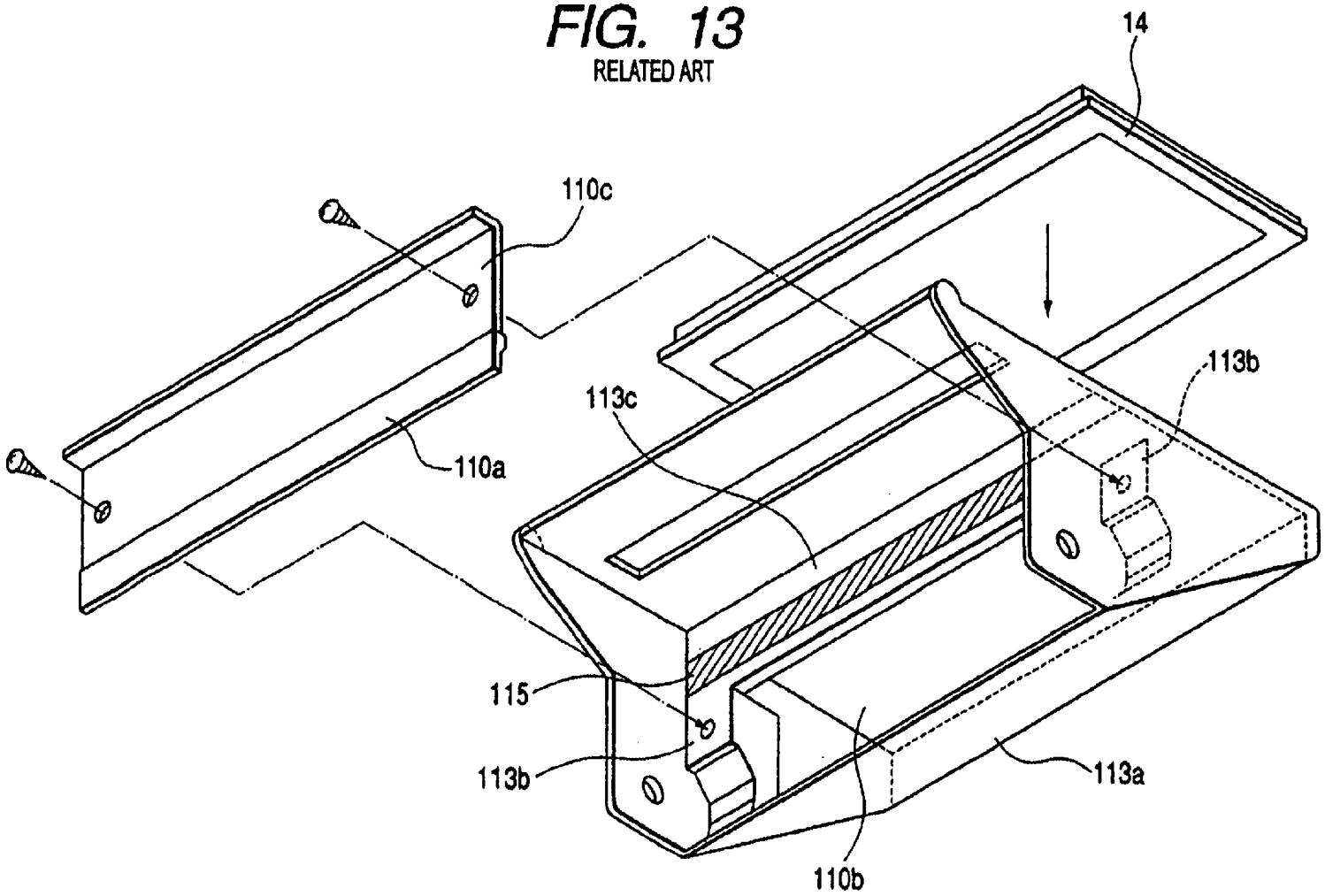
FIG. 13 RELATED ART
FIG. 13 is an exploded perspective view illustrating a structure of the conventional process cartridge.
Figure 14:
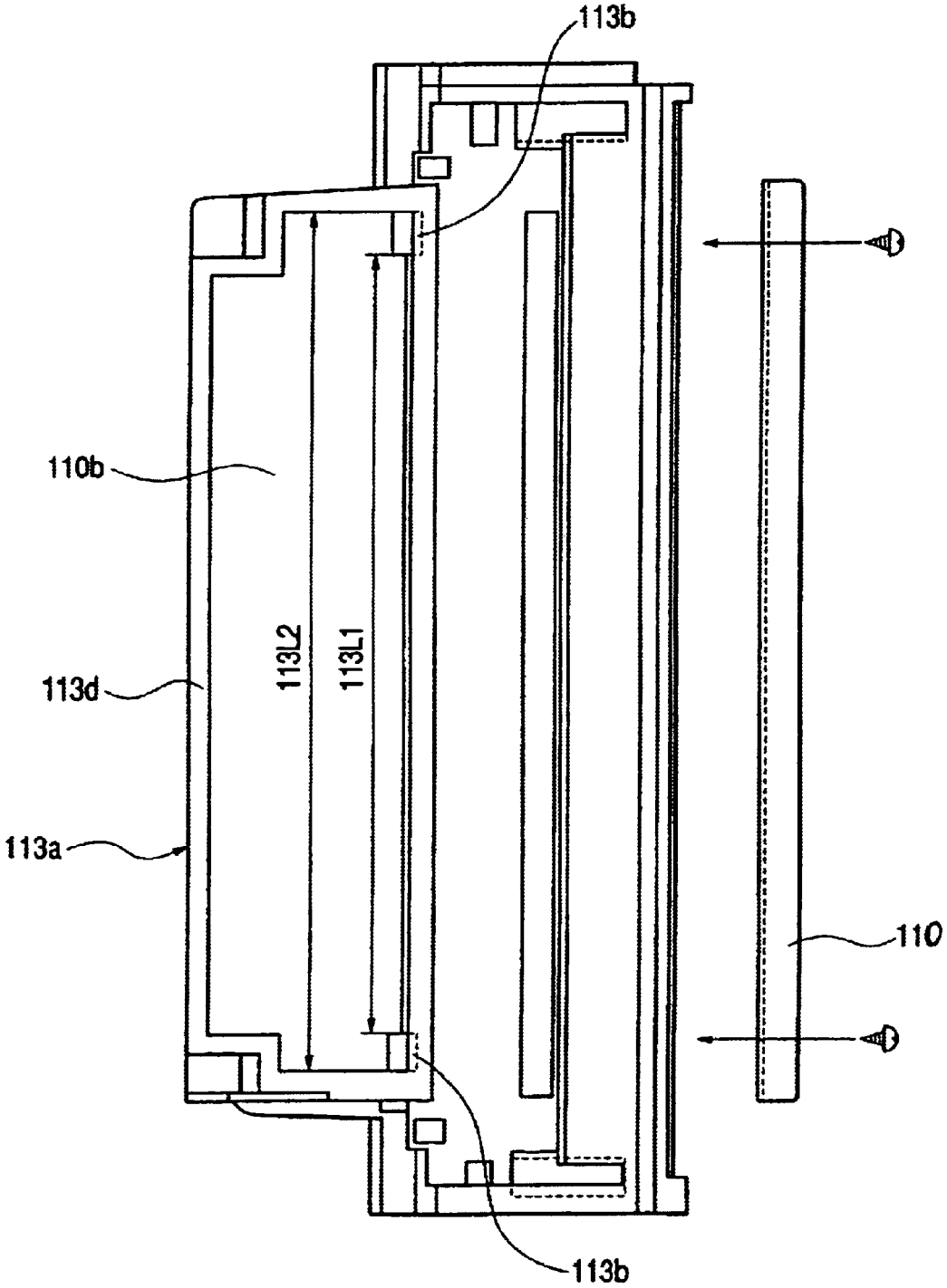
FIG. 14 RELATED ART
FIG. 14 is a view illustrating a structure of the conventional process cartridge.

Also, as shown in FIG. 10, the toner scraped off by the cleaning blade 10*a* enters the waste toner reservoir 10*b* substantially in the tangential direction (in the direction indicated by the arrow O) at the cross point of the photosensitive drum 7 with the cleaning blade 10*a*. The toner splashed substantially in the tangential direction of the photosensitive drum 7 accumulates on the surface that the toner contacts first, i.e., on the lower side from the extension plane of the support member lower surface 10*f* and accumulates in the deeper side (in the left hand in the drawing) of the waste toner reservoir. Accordingly, as shown in FIG. 11, the toner resides within the waste toner reservoir 10*b* in the order of E, F and G.

Figure 15:
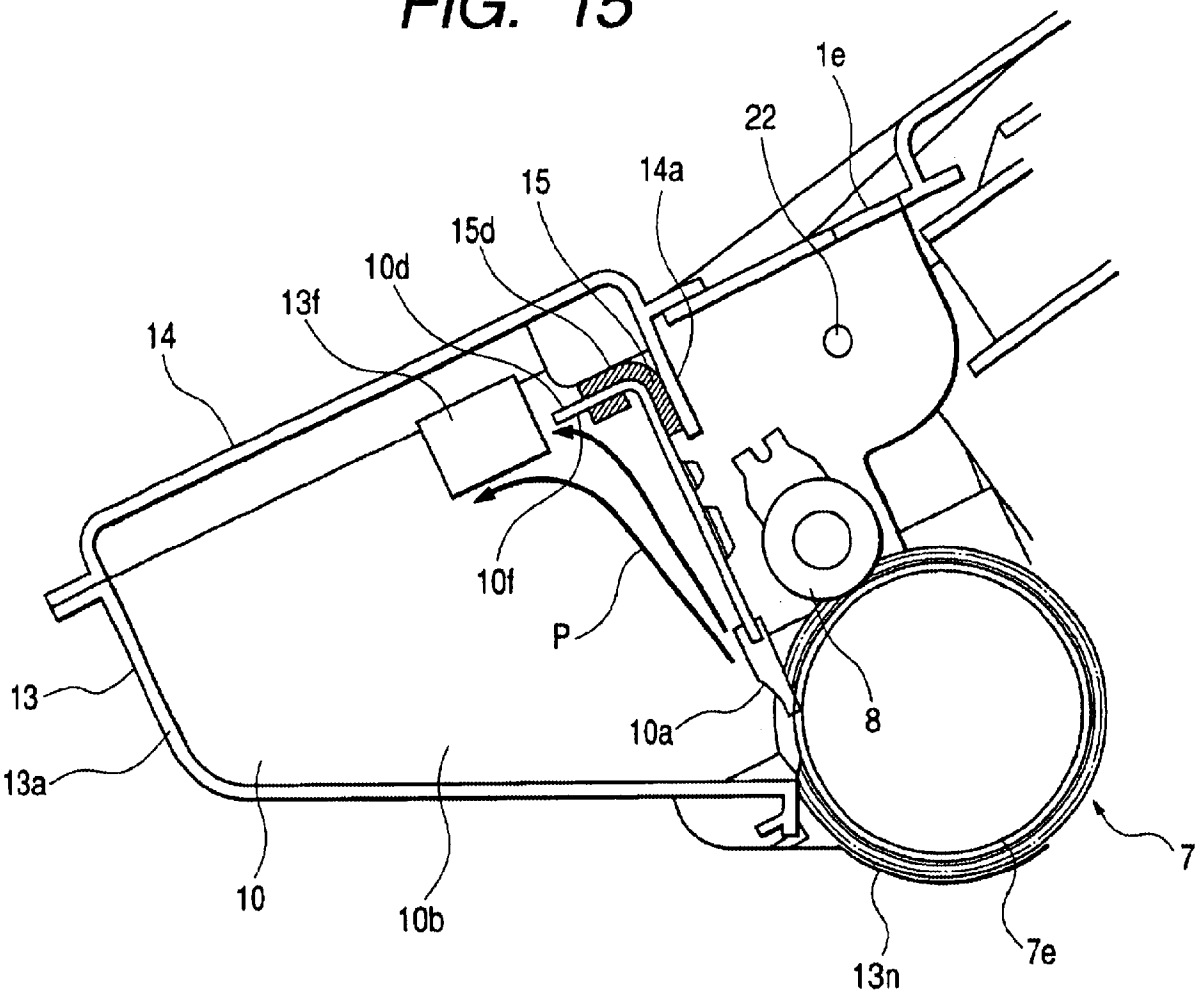
FIG. 15 is a cross-sectional view illustrating how toner enters a cleaning container that is different in structure from the second embodiment.
Figure 16:
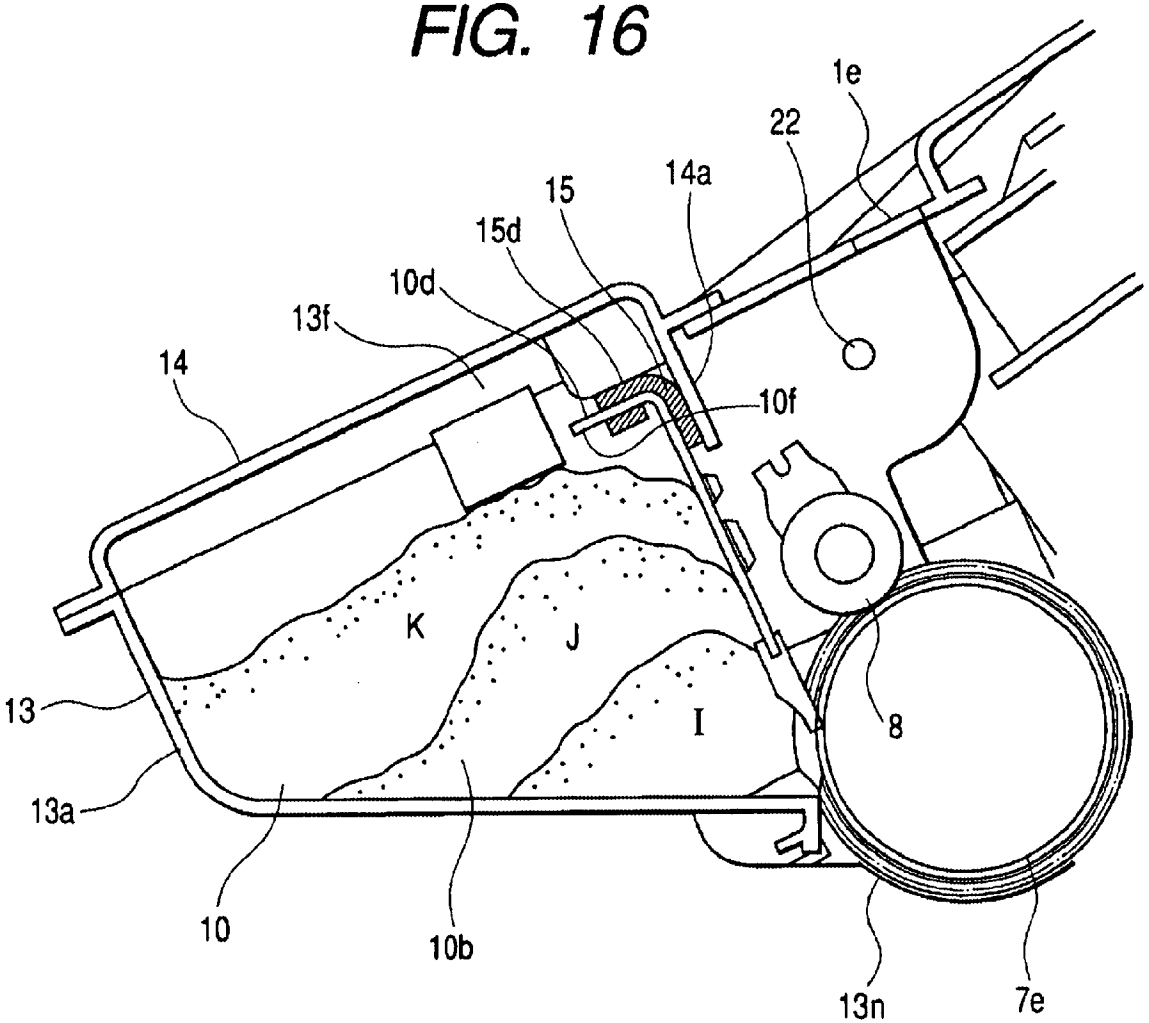
FIG. 16 is a cross-sectional view illustrating how the toner accumulates in the cleaning container that is different in structure from the second embodiment.

Inversely, it is possible to locate the beam 13*f* below the extension plane of the support member lower surface 10*f* of the cleaning blade 10*a* unlike the second embodiment. In this case, the toner scraped by the cleaning blade 10*a* enters the waste toner reservoir 10*b* in a direction indicated by the arrow P shown in FIG. 15. As shown in FIG. 15, the toner splashed substantially in the tangential direction of the photosensitive drum 7 accumulates on the lower side of the extension plane of the lower surface of the beam 13*f* and on the deeper side (in the left hand in the drawing) of the waste toner reservoir. Accordingly, the toner accumulates within the waste toner reservoir 10*b* in the order of I, J and K as indicated in FIG. 16. As a result, since the volume of the waste toner reservoir 10*b* could not effectively be used, the cleaning container is enlarged.

As described above, it is preferable that the beam 13*f* is located above the extension plane of the support member lower surface 10*f* of the cleaning blade 10*a* to thereby effectively fill the waste toner into the waste toner reservoir 10*b*, which leads to the miniaturization of the cleaning container.

As described above, in the cleaning apparatus, the beam for connecting both side surfaces in the longitudinal direction of the cleaning container in the vicinity of the welding portion with the cleaning lid is provided in the cleaning container for holding the cleaning blade, whereby the rigidity of the periphery of the welding portion of the cleaning container is enhanced. When the cleaning container and the cleaning lid are welded and connected together, the cleaning lid follows the shape of the cleaning container having high rigidity. Accordingly, the deformation upon the welding operation of the cleaning container may be reduced as much as possible. Accordingly, since the deformation due to the welding operation of the cleaning blade mounting portion may also be suppressed, it is possible to maintain the positional relation between the cleaning blade and the photosensitive drum with high accuracy. For this reason, the step for measuring and confirming the relationship between the cleaning blade and the photosensitive drum may be dispensed with or may be done by sampling (not for all the steps) to thereby reduce the number of the steps. Also, there is no remarkable positional displacement of the cleaning blade and the photosensitive drum and there are no needs to correct this.

Also, the beam is located above the support member lower surface of the cleaning blade so that the toner may be filled in the waste toner reservoir with a high efficiency to thereby make it possible to make the cleaning apparatus small in size.

The present invention is not limited to the above-described embodiments and various modifications and changes are possible within the scope of the spirit of the present invention.

What is claimed is:

1. A cleaning apparatus comprising:

a cleaning member configured and positioned to clean off toner from an image bearing member;

a support member configured and positioned to support said cleaning member;

a receiving portion configured and positioned to receive the toner cleaned off by said cleaning member, said receiving portion including a cleaning frame having two end surfaces and a deep side; and a connecting portion configured and positioned to connect said two end surfaces of said cleaning frame in a longitudinal direction of said cleaning member, wherein said support member is provided with a bent portion bent toward the deep side of said cleaning frame, and said connecting portion is located above an extension plane extending from said bent portion toward the deep side and within said receiving portion.

2. A cleaning apparatus according to claim 1, wherein said connecting portion is a beam.

3. A cleaning apparatus according to claim 1, wherein said cleaning frame is provided with a first opening portion opposed to the image bearing member and a second opening portion on top of said cleaning frame, wherein said cleaning member covers a part of said first opening portion, wherein said cleaning apparatus further comprises a lid member configured and positioned to cover the second opening portion, and wherein said lid member is provided on an upper portion of said receiving portion.

4. A cleaning apparatus according to claim 1, wherein said cleaning frame is provided with a holding portion configured and positioned to hold said support member.

5. A cleaning apparatus according to claim 1, wherein said cleaning frame is provided with a holding portion configured and positioned to hold the image bearing member.

6. A cleaning apparatus according to claim 1, wherein the image bearing member is a photosensitive member.

7. A cleaning apparatus according to claim 1, wherein said cleaning apparatus is detachably mountable to a main body of an image forming apparatus.

8. A cleaning apparatus according to claim 1, wherein said cleaning apparatus is detachably mountable to a main body of an image forming apparatus together with the image bearing member.

* * * * *